US010033131B2

(12) United States Patent
Uchiyama et al.

(10) Patent No.: US 10,033,131 B2
(45) Date of Patent: Jul. 24, 2018

(54) SEAL MEMBER AND WATERPROOF CONNECTOR

(71) Applicant: Sumitomo Wiring Systems, Ltd., Yokkaichi, Mie (JP)

(72) Inventors: Yoshihiro Uchiyama, Mie (JP); Ryotaro Ishikawa, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/604,086

(22) Filed: May 24, 2017

(65) Prior Publication Data

US 2017/0373429 A1 Dec. 28, 2017

(30) Foreign Application Priority Data

Jun. 22, 2016 (JP) ..... 2016-123271

(51) Int. Cl.
*H01R 13/52* (2006.01)

(52) U.S. Cl.
CPC ..... *H01R 13/5202* (2013.01); *H01R 13/521* (2013.01); *H01R 13/5208* (2013.01)

(58) Field of Classification Search
CPC ..... H01R 13/5202; H01R 13/521
USPC ..... 439/660
See application file for complete search history.

(56) References Cited

U.S. PATENT DOCUMENTS 5,823,811 A * 10/1998 Blanchfield ..... H01R 13/5025 439/274
6,053,753 A * 4/2000 Kunkle ..... H01R 13/5221 439/275
6,203,348 B1 * 3/2001 Fukuda ..... H01R 13/5208 439/271
6,494,731 B1 * 12/2002 Suzuki ..... H01R 13/5208 439/275
7,033,216 B2 * 4/2006 Ito ..... H01R 13/5208 439/275
7,338,319 B2 * 3/2008 Casses ..... H01R 13/5208 439/274
7,922,530 B2 * 4/2011 Chazottes ..... H01R 13/5208 439/587
8,771,014 B2 * 7/2014 Nakamura ..... H01R 13/5208 439/587
9,147,950 B2 * 9/2015 Ballard ..... H01R 13/506
(Continued)

FOREIGN PATENT DOCUMENTS

JP 2015-035404 2/2015

*Primary Examiner* — Alexander Gilman
(74) *Attorney, Agent, or Firm* — Gerald E. Hespos; Michael J. Porco; Matthew T. Hespos

(57) ABSTRACT

A seal (30) to be mounted into a rear part of a housing 20 and is formed with seal holes (32) configured to allow wires (26) connected to rear parts of terminal fittings (24) to pass therethrough in a liquid-tight manner. The seal (30) includes a body (31) constituting rear areas (32R) of the seal holes (32) and having an outer peripheral lip (37) formed on an outer periphery. An area between inner peripheries of the seal holes (32) and the outer peripheral lip (37) defines a solid resilient portion (39). Following portions (40) project forwardly of the outer peripheral lip (37) from a front surface of the body (31). The following portions (40) constitute front areas (32F) of the seal holes (32) and are resiliently deformable in directions intersecting a penetrating direction of the seal holes (32).

11 Claims, 8 Drawing Sheets

(56) References Cited

U.S. PATENT DOCUMENTS

2004/0092163 A1* 5/2004 Nagayasu ..... H01R 13/5208
439/587
2011/0300731 A1* 12/2011 Nakamura ..... H01R 13/504
439/271

* cited by examiner

SEAL MEMBER AND WATERPROOF CONNECTOR

BACKGROUND

1. Field of the Invention.

The invention relates to a seal and a waterproof connector.

2. Description of the Related Art.

Japanese Unexamined Patent Publication No. 2015-035404 discloses a connector with a housing, terminal fittings inserted into the housing from behind and a seal mounted in a rear end part of the housing. The seal is formed with a seal holes penetrating in a front-rear direction. A wire fixed to a rear end part of the terminal fitting is inserted through each seal hole in a liquid-tight manner.

In the above connector, a movement of the outer periphery of the seal is restrained substantially over the entire length. Thus, when a part of the wire rearward of the seal is pulled in a radial direction, the seal cannot follow the deformation of the wire and a degree of adhesion between the inner periphery of the seal hole and the outer periphery of the wire may be reduced.

The present invention was completed based on the above situation and aims to improve the reliability of a sealing function.

SUMMARY

A first aspect of the invention is directed to a seal to be mounted into a rear end part of a housing into which terminal fittings are to be inserted from behind. The seal is formed with seal holes configured to allow wires connected to rear end parts of the terminal fittings to pass therethrough in a liquid-tight manner. The seal includes a body that constitutes rear end side areas of the seal holes and the body has a seal functioning portion formed on an outer periphery. An area between inner peripheries of the seal holes and the seal functioning portion is a solid resilient portion. The seal also has a following portion projecting forward of the seal functioning portion from a front surface of the body. The following portion forms front areas of the seal holes and is resiliently deformable in a direction intersecting a penetrating direction of the seal holes in a state mounted in the housing.

A second aspect of the invention is directed to a waterproof connector with a housing into which plurality of terminal fittings are to be inserted from behind. A seal is mounted in a rear part of the housing. Seal holes are formed in the seal and are configured to allow wires connected to rear end parts of the terminal fittings to pass therethrough in a liquid-tight manner. The seal includes a body that forms rear areas of the seal holes and a seal functioning portion is formed on an outer periphery. An area between inner peripheries of the seal holes and the seal functioning portion defines a solid resilient portion. A following portion projects forward of the seal functioning portion from a front surface of the body portion. The following portion forms front ends of the seal holes and can resiliently deforms in a direction intersecting a penetrating direction of the seal holes in a state mounted in the housing.

The following portion will deform resiliently and follow the inclination of the wire if a part of the wire rearward the seal is pulled in a radial direction. Thus, the inner periphery of the front area of the seal hole defined by the following portion remains in close contact with the outer periphery of the wire in a liquid-tight manner. Further, a part between the seal functioning portion and the inner peripheries of the rear areas of the seal holes define the solid resilient portion in an area of the body portion where the seal functioning portion is formed. Thus, the seal functioning portion exhibits a desired sealing function.

The following portion may constitute only one seal hole and plural following portions may individually project from the body. According to this configuration, even if each wire is pulled individually, the seal hole can follow such a movement of the wire.

A peripheral wall may project forward from an outer peripheral edge of the front surface of the body and may have an auxiliary seal formed on an outer periphery. According to this configuration, the sealing function of the outer periphery of the seal is improved by providing the auxiliary seal in addition to the seal functioning portion.

A groove may be formed between the following portion and the peripheral wall and may be configured to avoid interference with the peripheral wall when the following portion is deformed resiliently. According to this configuration, the following properties of the following portion are improved.

A link may be provided to link an inner periphery of the peripheral wall and the outer periphery of the following portion. According to this configuration, improper deformation of the peripheral wall toward an outer periphery can be restricted.

DETAILED DESCRIPTION

Figure 1:
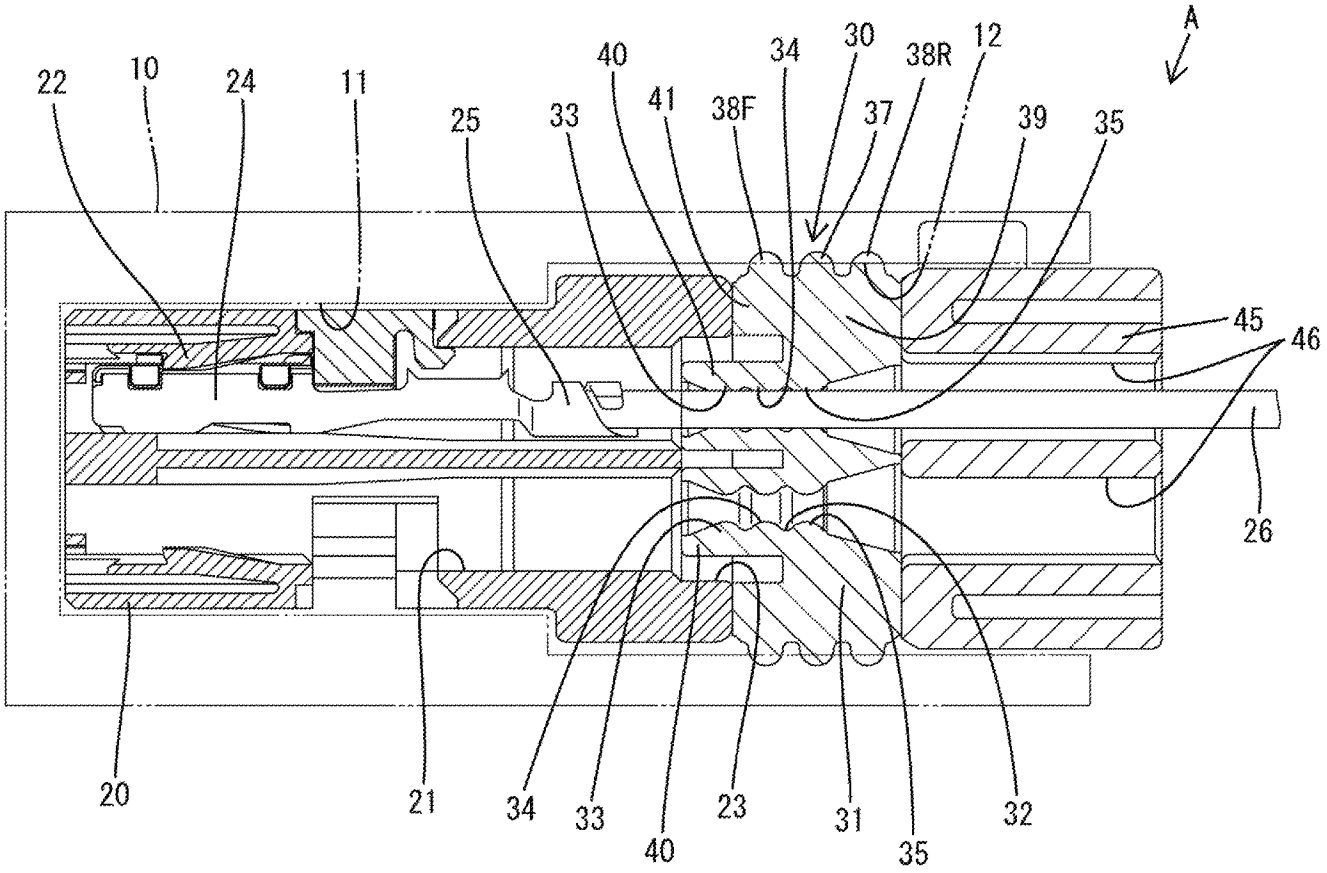
FIG. 1 is a side view in section of a first embodiment.

A first embodiment of the invention is described with reference to FIGS. 1 to 5. Note that, in the following description, a left side in FIGS. 1, 2, 4 and 5 is defined as a front side concerning a front-rear direction. Concerning a vertical direction, upper and lower sides of FIGS. 1 to 4 are defined as upper and lower sides. A waterproof connector A of the first embodiment includes a frame 10 made of synthetic resin, a housing 20 made of synthetic resin, a plurality of terminal fittings 24, a seal 30 made of rubber and a rear holder 45 made of synthetic resin.

The frame 10 includes an accommodating section 11 open rearward. An area of the inner peripheral surface of the frame 10 near the rear end serves as a sealing surface 12 smoothly continuous over the entire circumference. The entire housing 20, the entire seal member 30 and a front end part of the rear holder 45 are accommodated into the accommodating section 11 from behind. The seal member 30 accommodated in the accommodating section 11 is arranged substantially at the same positon as the sealing surface 12 in the front-rear direction.

The housing 20 is in the form of a flat block long in a lateral direction. Terminal accommodating chambers 21 penetrate through the housing 20 in the front-rear direction. The terminal accommodating chambers 21 are arranged separately in upper and lower stages. The terminal accommodating chambers 21 in the upper stage and those in the lower stages are respectively arranged at regular intervals. The terminal fittings 24 are inserted into each terminal accommodating chamber 21 from behind. The inserted terminal fitting 24 is retained by a locking action of a locking lance 22 formed in the terminal accommodating chamber 21. Further, one accommodation recess 23 is formed in a rear end part of the housing 20 and communicates with rear ends of all of the terminal accommodating chambers.

The seal 30 is long in the lateral direction and has an elliptical front shape. The seal 30 is a single component including one body portion 31, following portions 40 corresponding to the terminal accommodating chambers 21, and one peripheral wall 41. The seal 30 is formed with seal holes 32 penetrating through the seal 30 in the front-rear direction at positions corresponding to the terminal accommodating chambers 21. The seal holes 32 are spaces for allowing wires 26 connected to crimping portions 25 at rear end parts of the respective terminal fittings 24 to pass therethrough in a liquid-tight manner. The seal hole 32 has a circular cross-sectional shape perpendicular to an axis thereof.

A first inner peripheral lip 33 is formed on a front end part of the inner periphery of the seal hole 32 and extends in a circumferential direction continuously over the entire circumference. A second inner peripheral lip 34 is formed at a position of the inner periphery of the seal hole 32 behind and near the first inner peripheral lip 33 and extends in the circumferential direction continuously over the entire circumference. A third inner peripheral lip 35 is formed at a position of the inner periphery of the seal hole 32 behind and near the second inner peripheral lip 34 and extends in the circumferential direction continuously over the entire circumference.

Minimum inner diameters of the first inner peripheral lip 33, the second inner peripheral lip 34 and the third inner peripheral lip 35 are equal. Further, a tapered guiding surface 36 is formed on a rear end part of the inner periphery of the seal hole 32 and has an inner diameter gradually increased toward the rear. A minimum inner diameter of the guiding surface 36 is larger than those of the first to third inner peripheral lips 33, 34 and 35.

The body 31 constitutes a substantially rear half of the seal 30 in the front-rear direction. The body 31 has an elliptical front shape long in the lateral direction. An outer peripheral lip 37 (seal functioning portion as claimed) is formed at a front position on the outer periphery of the body 31 and extends in the circumferential direction continuously over the entire circumference. A rear outer peripheral auxiliary lip 38R is formed at a rear position on the outer periphery of the body 31 and in the circumferential direction continuous over the entire circumference. Only two lips, i.e. the outer peripheral lip 37 and the rear outer peripheral auxiliary lip 38R, are formed on the outer periphery of the body 31. Projecting dimensions of the outer peripheral lip 37 and the rear outer peripheral auxiliary lip 38R from the outer peripheral surface of the body 31 are equal to each other.

The body 31 constitutes rear areas 32R of the seal holes 32. The third inner peripheral lip 35 and the guiding surface 36 are formed in the rear area 32R of the seal hole 32. The first and second inner peripheral lips 33, 34 are arranged in front of the body 31. The outer peripheral lip 37 and the third inner peripheral lip 35 are arranged substantially at the same position in the front-rear direction. Specifically, a front part of the outer peripheral lip 37 and a rear part of the third inner peripheral lip 35 are arranged in the same area in the front-rear direction. Further, the rear outer peripheral auxiliary lip 38R and the guiding surface 36 are arranged substantially at the same position in the front-rear direction.

The body 31 is a solid resilient portion 39 in the entirety thereof. Thus, there are no hollow parts such as grooves and recesses between the inner peripheral surfaces of the rear end side areas 32R of the seal holes 32 and the outer peripheral surface of the body 31. Further, there are no hollow parts such as grooves and recesses between the inner peripheral surfaces of the rear end side areas 32R of the vertically adjacent seal holes 32. Similarly, there are no hollow parts such as grooves and recesses also between the inner peripheral surfaces of the rear areas 32R of the laterally adjacent seal holes 32.

The following portions 40 are arranged separately in upper and lower stages to individually correspond to the respective terminal accommodating chambers 21. Each following portion 40 projects forward (toward the terminal fitting 24) from the front surface of the body 31. The front end (projecting end) of each following portion 40 is located in front of the front end of the outer peripheral lip 37. Each following portion 40 constitutes a front area 32F of one respective seal hole 32. The first and second inner peripheral lips 33, 34 are formed in the front area 32F of the seal hole 32.

Each following portion 40 is individually and resiliently displaceable with respect to the body 31. Each following portion 40 can displace to incline in directions intersecting axial directions (front-rear direction) of the seal hole 32 and the wire 26 in the seal hole 32. The following portions 40 adjacent to each other in the vertical or lateral direction are spaced apart so as not to contact or interfere with each other when being resiliently deformed. The first and second inner peripheral lips 33, 34 displace integrally with the following portion 40 when the following portion 40 is deformed.

The peripheral wall 41 is arranged over the entire circumference along an outer peripheral edge part of the front surface of the body 31 and projects forward from the body 31. The front end of the peripheral wall 41 is located behind front ends of the following portions 40. The peripheral wall 41 is formed to collectively enclose all of the following portions 40. Grooves 47 are formed between the following portions 40 and the peripheral wall 41 and are configured so that the following portions 40 do not contact or interfere with the peripheral wall 41 when being resiliently deformed in the vertical direction or lateral direction.

Figure 3:
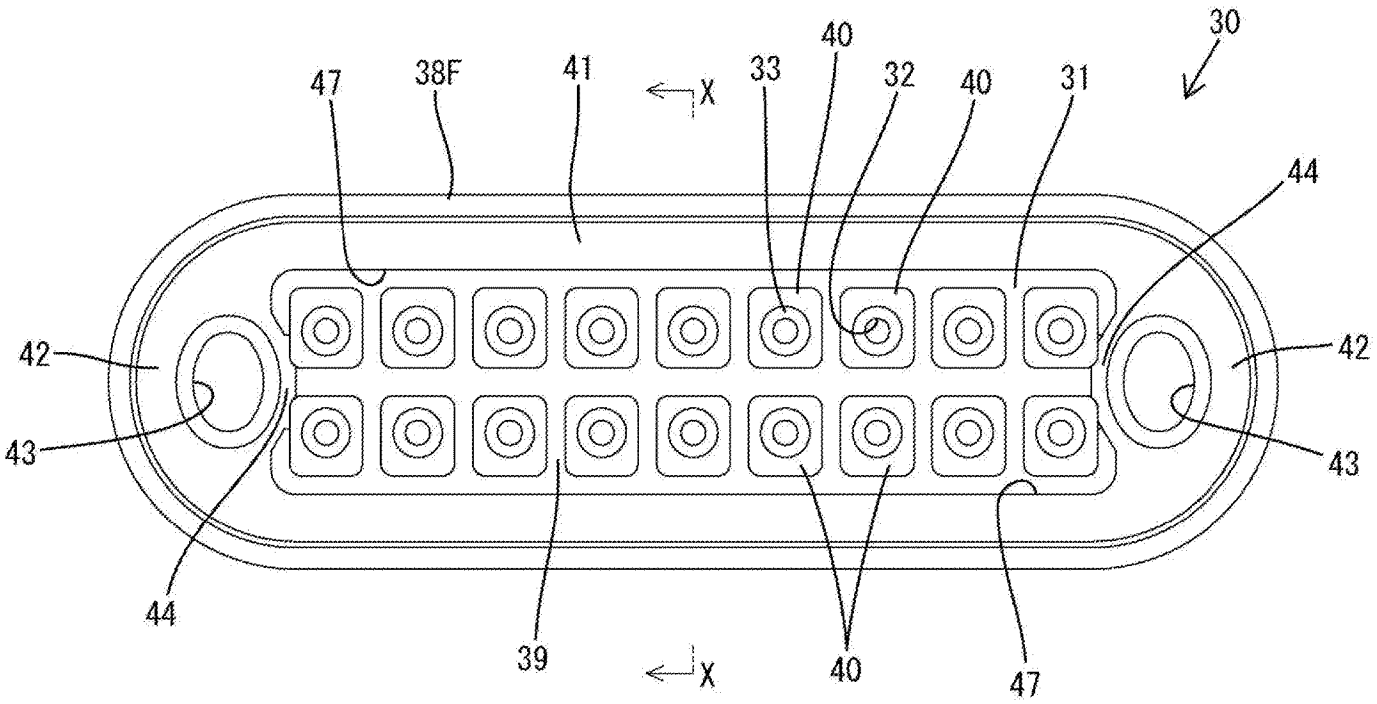
FIG. 3 is a front view of a seal.
Figure 4:
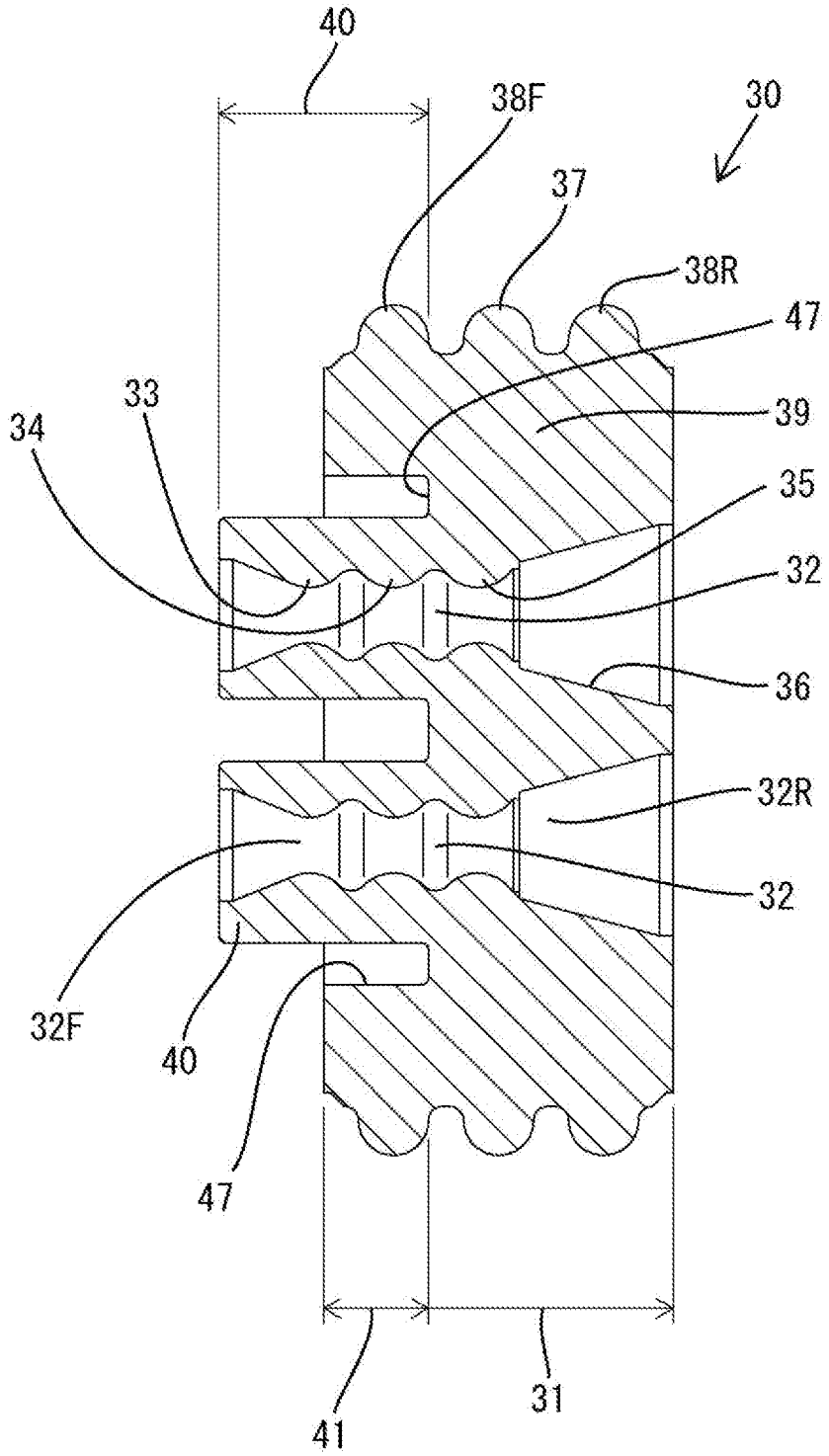
FIG. 4 is a section along X-X of FIG. 3.
Figure 5:
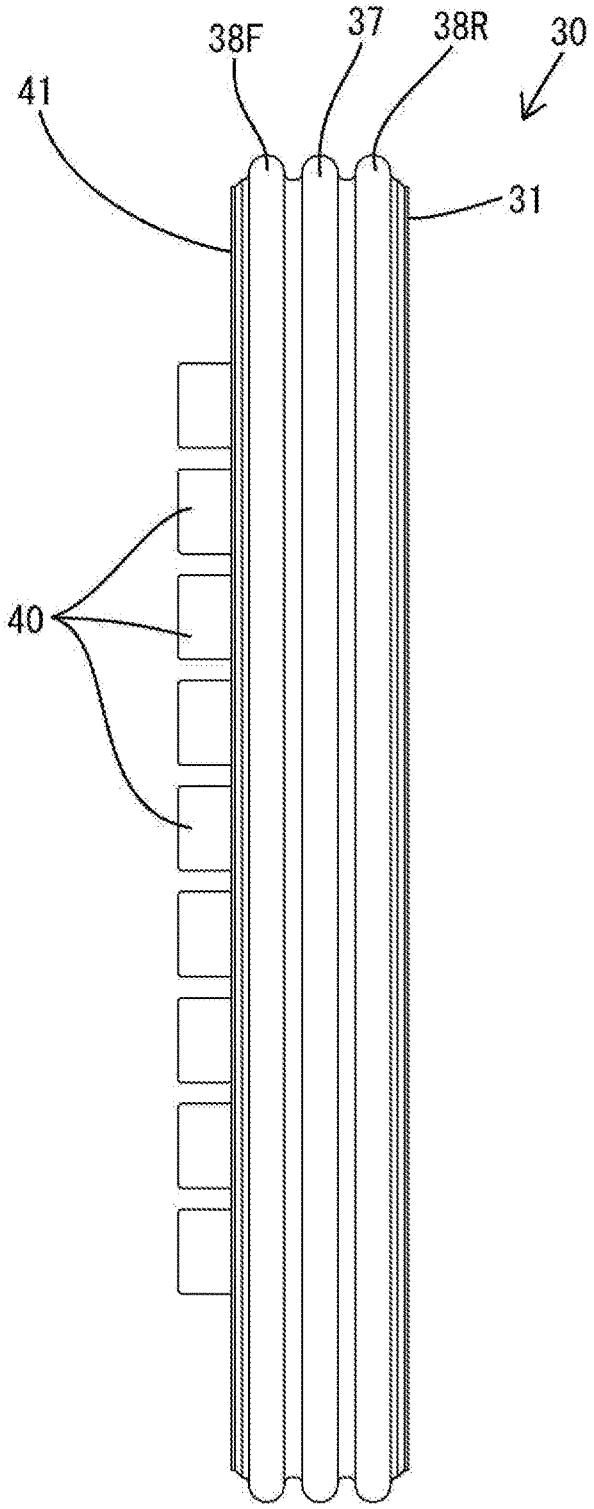
FIG. 5 is a plan view of the seal.

As shown in FIG. 3, left and right ends of the peripheral wall 41 define wide portions 42 having a larger dimension between outer and inner peripheries as compared to substantially straight upper and lower wall portions. Left and right positioning holes 43 are formed in the left and right wide portions 42 and penetrate from the front surface of the peripheral wall 41 to the rear surface of the body 31. The positioning holes 43 enable the rear holder 45 to be positioned vertically and laterally with respect to the housing 20. The positioning holes 43 are arranged on both left and right end parts of the body 31, i.e. arranged at opposite left and right sides of all the seal holes 32. Further, inner peripheral surfaces of the wide portions 42 and four following portions 40 located on both ends in the lateral direction are coupled by linking portions 44.

A front outer peripheral auxiliary lip 38F is formed on the outer periphery of the peripheral wall 41 and extends in the circumferential direction and continuous over the entire circumference. Since the peripheral wall 41 is located in front of the body 31, the front outer peripheral auxiliary lip 38F is located in front of the outer peripheral lip 37. Further, the outer peripheral surface of the peripheral wall 41 and that of the body 31 are continuous and flush with each other, and a projecting dimension of the front outer peripheral auxiliary lip 38F from the outer peripheral surface of the peripheral wall 41 and those of the outer peripheral lip 37 and the rear outer peripheral auxiliary lip 38R from the outer peripheral surface of the body 31 are equal.

The seal 30 is mounted into the housing 20 with the front end surface of the peripheral wall portion 41 held in contact with the rear surface of the housing 20. In a mounted state, all the following portions 40 are accommodated in the accommodation recess 23 of the housing 20. Further, the inner peripheral surface of the peripheral wall 41 is substantially continuous and flush with that of the accommodation recess 23. Thus, the following portions 40 and the inner peripheral surface of the accommodation recess 23 are spaced apart so that the following portions 40 do not contact or interfere with the inner peripheral surface of the accommodation recess 23 when being resiliently deformed in the vertical direction or lateral direction.

The rear holder 45 has a substantially elliptical shape long in the lateral direction similarly to the seal 30. The rear holder 45 is formed with through holes 46 corresponding respectively to the seal holes 32. Further, positioning projections (not shown) are formed on left and right end parts of the rear holder 45. The rear holder 45 is mounted with respect to the seal 30 to be held in close contact with the rear surface of the body 31 so that the positioning projections pass through the positioning holes 43. Projecting front ends of the positioning projections are locked to locking portions (not shown) of the housing 20. By this locking action, the rear holder 45 is fixed to the housing 20 and the seal 30 is mounted in the rear end part of the housing 20 while being sandwiched between the rear surface of the housing 20 and the front surface of the rear holder 45.

After the housing 20, the seal 30 and the rear holder 45 are assembled as described above, the terminal fittings 24 are passed through the through hole 46 from behind the rear holder 45 and inserted into the terminal accommodating chambers 21 through the seal holes 32. Associated with this, a front end part of each wire 26 connected to a rear end part of the respective terminal fitting 24 is inserted into the through hole 46 and the seal hole 32. In an inserted state, the three inner peripheral lips 33, 34 and 35 on the inner periphery of the seal hole 32 are held in close contact with the outer periphery of the wire 26 in a light-tight manner while being resiliently deformed. In this way, the intrusion of water is prevented in a path leading to the terminal accommodating chamber 21 through the seal hole 32.

After all the terminal fittings 24 are inserted into the housing 20, the housing 20, the seal member 30 and the rear holder 45 are accommodated into the accommodating section 11 of the frame 10. In a properly accommodated state, the outer peripheral lip 37, the front outer peripheral auxiliary lip 38F and the rear outer peripheral auxiliary lip 38R are held in close contact with the sealing surface 12 of the frame 10 while being resiliently deformed. In this way, the intrusion of water is prevented in a path leading to a front part of the housing 20 through a clearance between the inner peripheral surface of the frame 10 and the outer peripheral surface of the seal 30.

Next, functions of the first embodiment are described. Vertical and lateral dimensions of a front part of the terminal fitting 24 are larger than those of the crimping portion 25 on the rear end part of the terminal fitting 24. Thus, in the rear end part of the terminal accommodating chamber 21, a clearance is present between the crimping portion 25 of the terminal fitting 24 and the inner surface of the terminal accommodating chamber 21.

Figure 2:
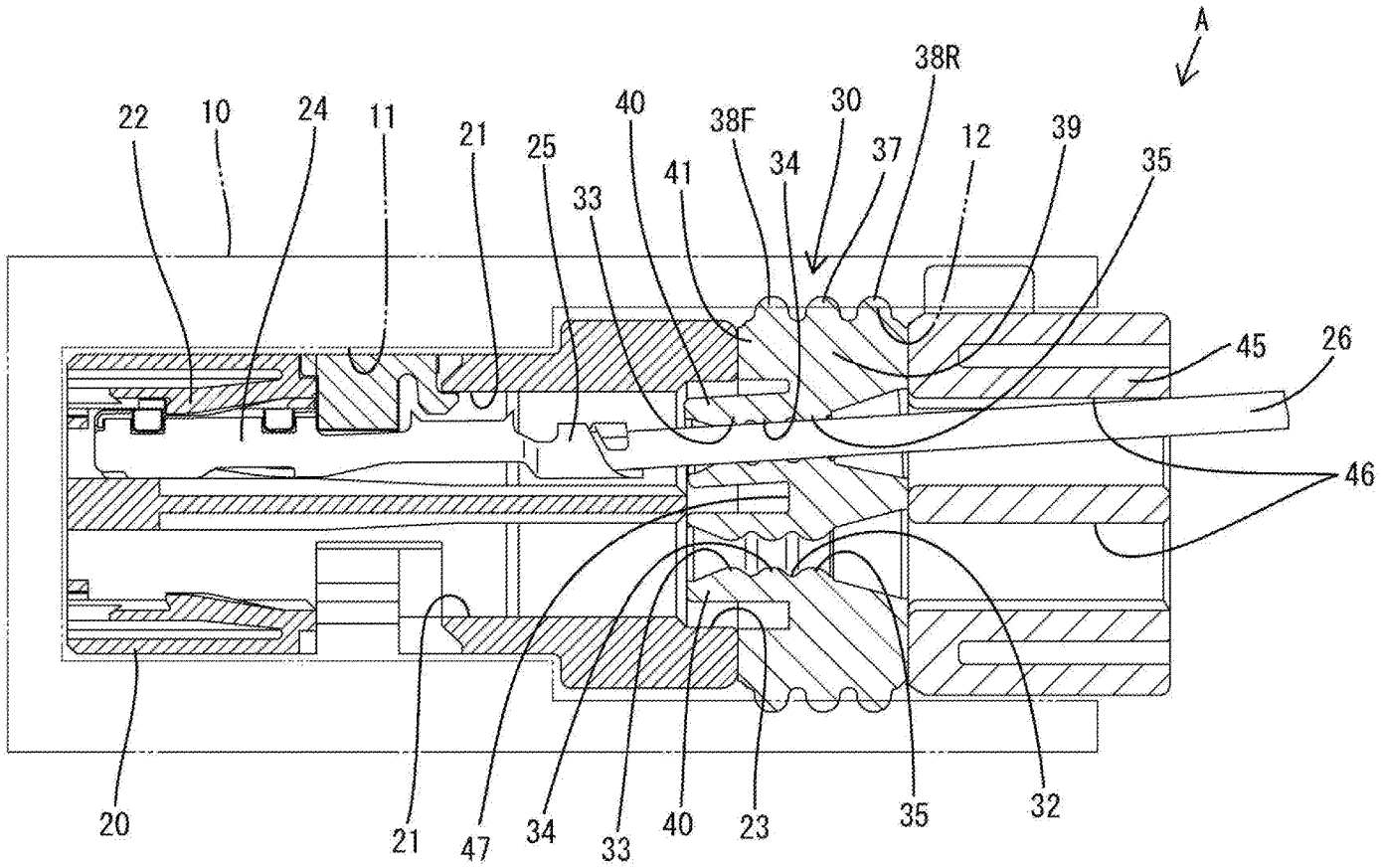
FIG. 2 is a side view in section showing a state where a wire is pulled upwardly.

The wire 26 extending rearward from the crimping portion 25 is drawn out rearwardly to the outside of the rear holder 45 through the seal 30 and the rear holder 45, and this drawn-out part may be subjected to a pulling force in a direction (vertical direction or lateral direction) intersecting the axis (front-rear direction) of the seal hole 32. For example, if the drawn-out part of the wire 26 is pulled up, as shown in FIG. 2, the wire 26 in an area passed through the seal 30 is inclined forwardly. At this time, the position of the crimping portion 25 is slightly lowered.

The following portion 40 then follows the posture inclination of the wire 26 and is obliquely resiliently deformed such that a front end faces down. At this time, since the first and second inner peripheral lips 33, 34 formed on the inner periphery of the following portion 40 become oblique integrally with the following portion 40, these inner peripheral lips 33, 34 are held in close contact with the outer periphery of the wire 26 over the entire circumference with a constant pressing force. In this way, the inner periphery of the seal hole 32 and the outer periphery of the wire 26 are reliably held in a liquid-tight state.

Further, the outer peripheral lip 37 of the body 31 is resiliently held in close contact with the sealing surface 12 of the frame 10 and the third inner peripheral lips 35 of the body 31 are resiliently held in close contact with the outer peripheries of the wires 26. Since the solid resilient portion 39 is present between the outer peripheral lip 37 and the third inner peripheral lip 35 in a radial direction of the wire 26, the resilient portion 39 (body 31) itself is not deformed significantly even if the following portion 40 is deformed resiliently. In this way, the outer peripheral lip 37 and the sealing surface 12 reliably are held resiliently in a liquid-tight state and the third inner peripheral lips 35 and the wires 26 also are held reliably in a liquid-tight state.

The connector A of this first embodiment includes the housing 20 into which the terminal fittings 24 are to be inserted from behind and the seal 30 mounted in the rear end part of the housing 20, and the seal 30 includes the seal holes 32 configured to allow the wires 26 connected to the rear end parts of the terminal fittings 24 to pass therethrough in a liquid-tight manner. The seal 30 includes the body 31 and the following portions 40. The body 31 constitutes the rear end side areas 32R of the seal holes 32 and the outer peripheral lip 37 is formed on the outer periphery of the body 31. An area between the inner peripheries of the seal holes 32 and the outer peripheral lip 37 is the solid resilient portion 39. Further, the following portions 40 project forward of the outer peripheral lip 37 from the front surface of the body 31 and constitute the front areas 32F of the seal holes 32. In the state mounted in the housing 20, the following portions 40 are resiliently deformable in directions intersecting with a penetrating direction of the seal holes 32.

If the part of the wire 26 extending rearward from the seal 30 is pulled in the radial direction (vertical or lateral), the following portion 40 is deformed resiliently, following the posture inclination of the wire 26. Thus, the inner periphery of the front area 32F of the seal hole 32 defining the following portion 40 is held in close contact with the outer periphery of the wire 26 in a liquid-tight manner. Further, since the solid resilient portion 39 is between the outer peripheral lip 37 and the rear end side areas 32R of the seal holes 32 in an area of the body 31 where the outer peripheral lip 37 is formed, the outer peripheral lip 37 exhibits a desired sealing function.

Further, one following portion 40 constitutes only one seal hole 32 and the plurality of following portions 40 individually project from the body portion 31. According to this configuration, even if each wire 26 is pulled individually, each following portion 40 is deformed individually resiliently in response to that movement of the wire 26. Thus, the seal hole 32 can flexibly follow the movement and inclination of the posture of the wire 26.

Further, since the peripheral wall 41 projects forward from the outer peripheral edge of the front surface of the body 31 and the front outer peripheral auxiliary lip 38F is formed on the outer periphery of the peripheral wall 41, the sealing function of the outer periphery of the seal 30 is improved by providing the front outer peripheral auxiliary lip 38F in addition to the outer peripheral lip 37. Further, the grooves 47 are formed between the following portions 40 and the peripheral wall 41 to avoid interference with the peripheral wall 41 when the following portions 40 are deformed. This enables the following portions 40 to be resiliently deformed at a sufficiently large angle without interfering with the peripheral wall 41 so that following properties of the following portions 40 are high. Further, since the inner periphery of the peripheral wall 41 and the outer peripheries of the following portions 40 are linked by the linking portions 44, there is no possibility that the peripheral wall 41 is deformed improperly toward an outer peripheral side.

Figure 6:
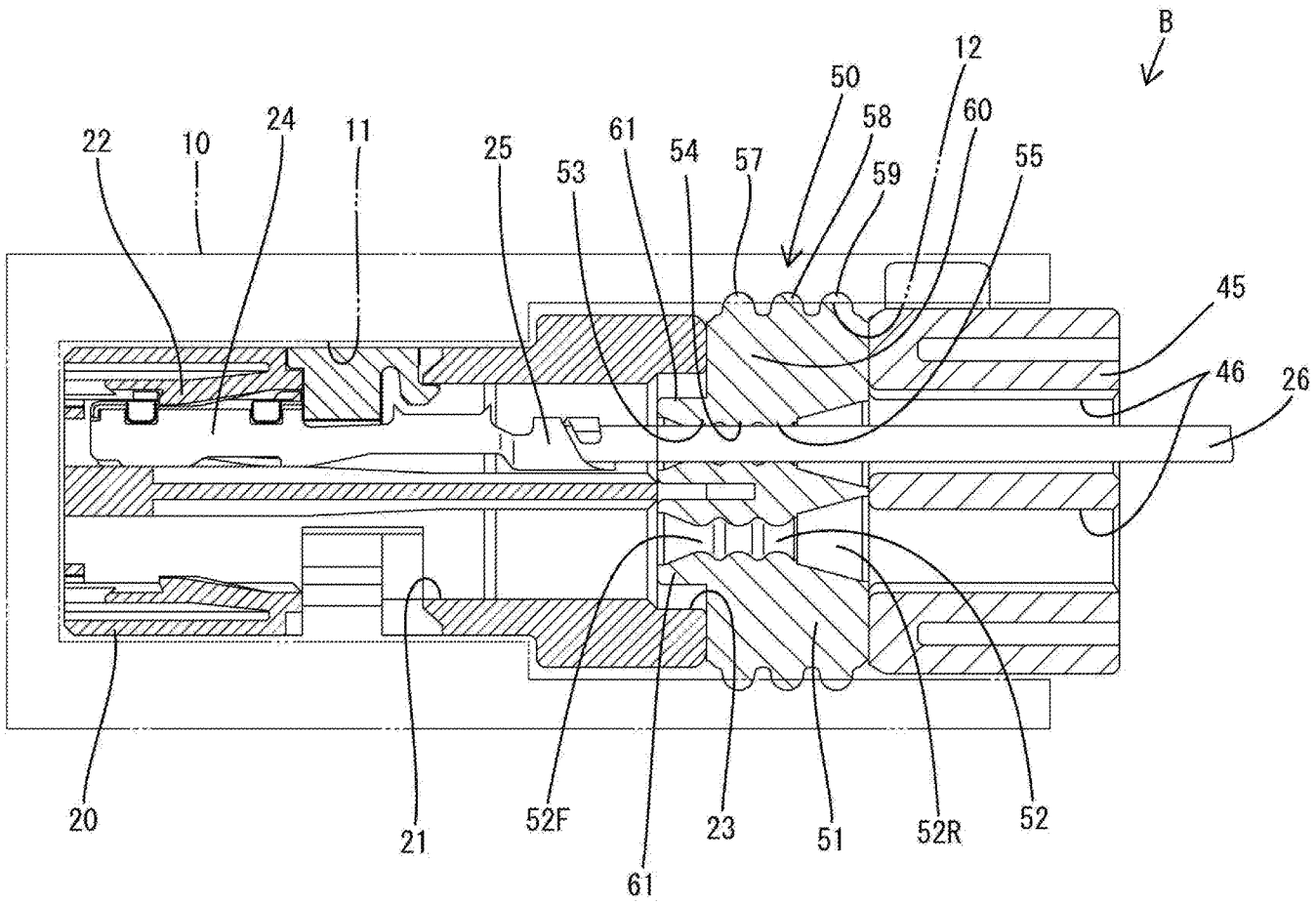
FIG. 6 is a side view in section of a second embodiment.
Figure 7:
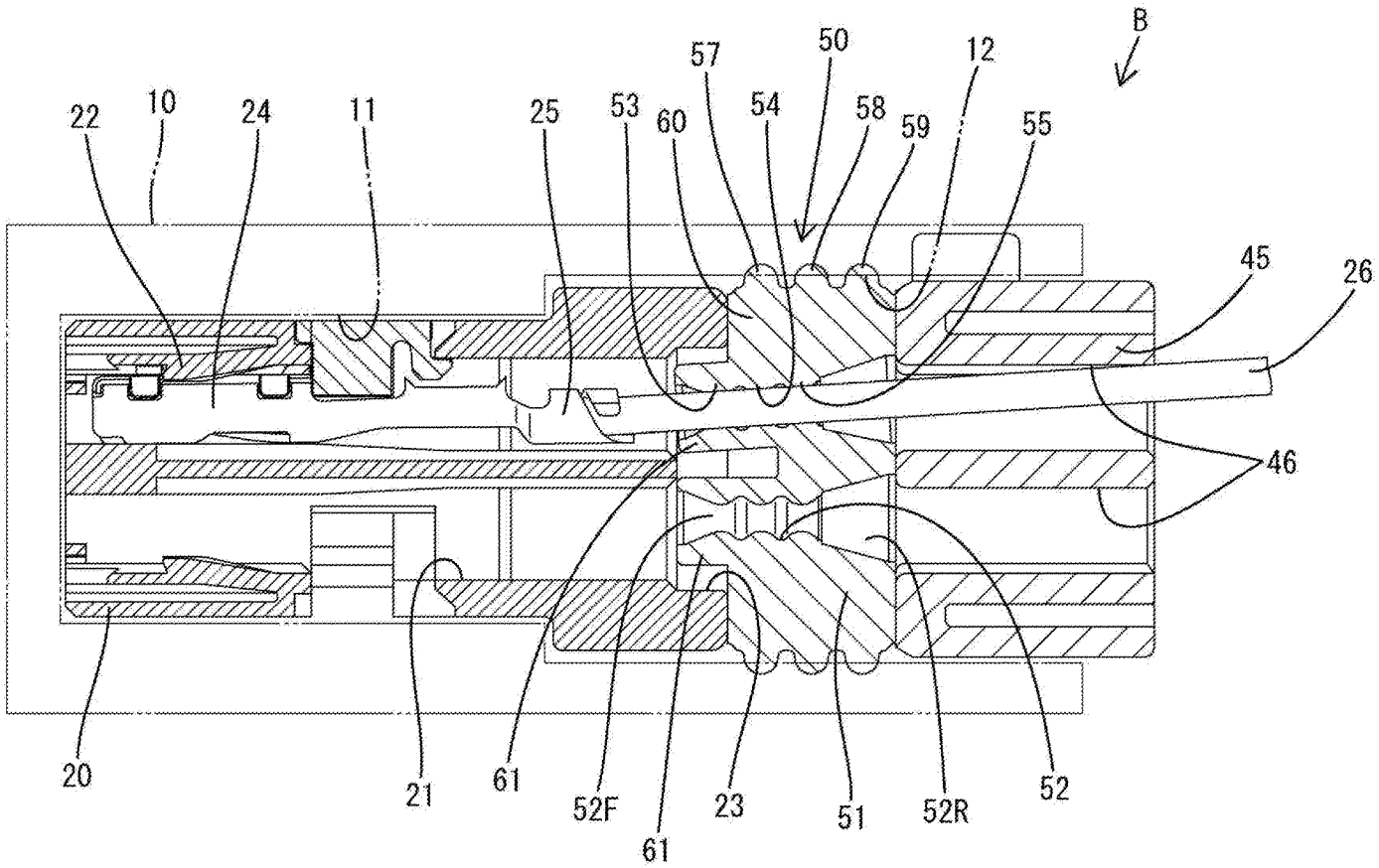
FIG. 7 is a side view in section showing a state where a wire is pulled.
Figure 8:
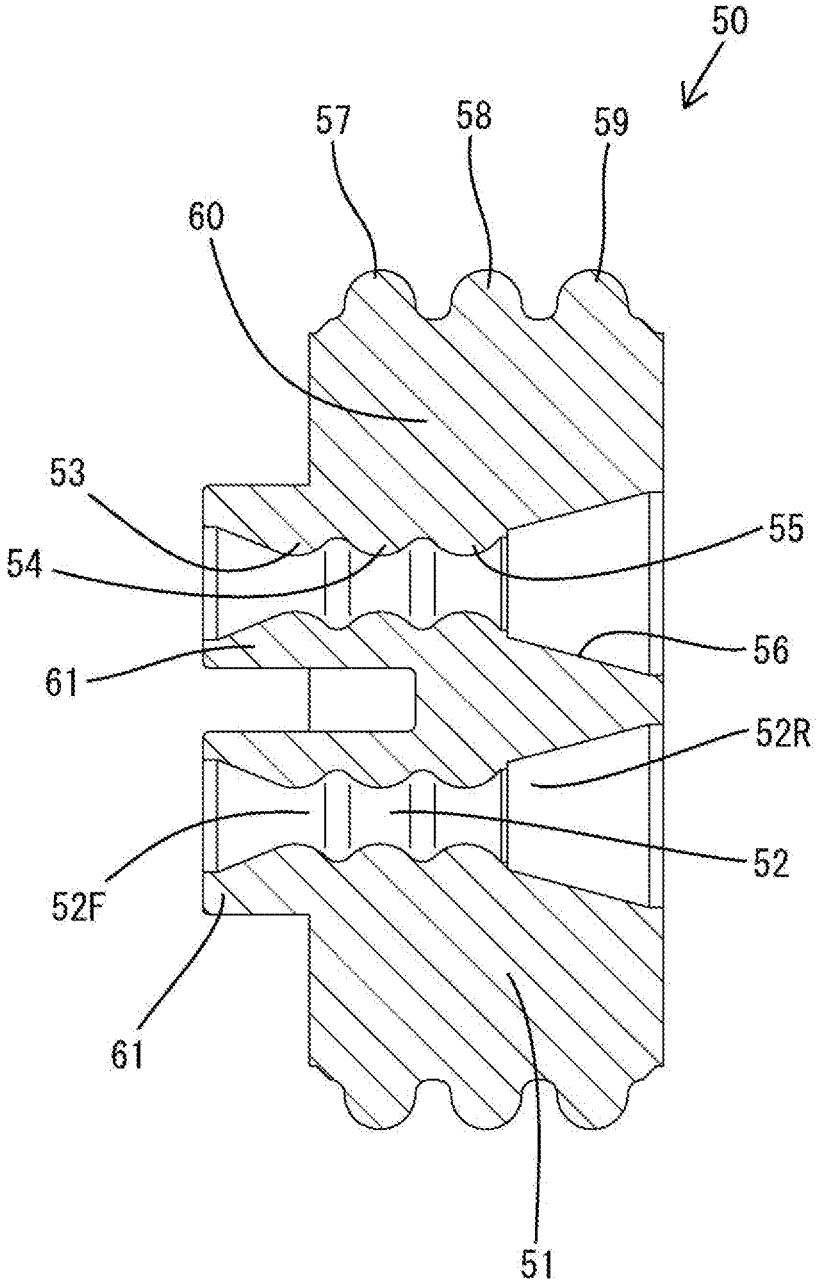
FIG. 8 is a side view in section of the seal.

Next, a second specific embodiment of the present invention is described with reference to FIGS. 6 to 8. In a waterproof connector B of this second embodiment, a seal 50 is different in configuration from that of the first embodiment. Since the other components (housing 20, terminal fittings 24, wires 26 and rear holder 45) are the same as in the above first embodiment, the same components are denoted by the same reference signs and the structures, functions and effects thereof are not described.

The seal 50 is shaped to be long in a lateral direction as a whole and has an elliptical front shape. The seal member 40 is a single component including one body portion 31 and a plurality of (as many as terminal accommodating chambers 21) following portions 61. The seal 50 is formed with a plurality of (as many as the terminal accommodating chambers 21) seal holes 52 penetrating through the seal 50 in a front-rear direction. The plurality of seal holes 52 are spaces for allowing the wires 26 connected to crimping portions 25 at rear end parts of the respective terminal fittings 24 to pass therethrough in a liquid-tight manner, and arranged at positions corresponding to the plurality of terminal accommodating chambers 21. The seal hole 52 has a circular cross-sectional shape perpendicular to an axis thereof.

A first inner peripheral lip 53 in the form of a projecting rib extending in a circumferential direction and continuous over the entire circumference is formed on a front end part of the inner periphery of the seal hole 52. A second inner peripheral lip 54 in the form of a projecting rib extending in the circumferential direction and continuous over the entire circumference is formed at a position of the inner periphery of the seal hole 52 behind and near the first inner peripheral lip 53. A third inner peripheral lip 55 in the form of a projecting rib extending in the circumferential direction and continuous over the entire circumference is formed at a position of the inner periphery of the seal hole 52 behind and near the second inner peripheral lip 54.

Minimum inner diameters of the first inner peripheral lip 53, the second inner peripheral lip 54 and the third inner peripheral lip 55 are equal. Further, a tapered guiding surface 56 having an inner diameter gradually increased toward a rear side is formed on a rear end part of the inner periphery of the seal hole 52. A minimum inner diameter of the guiding surface 56 is larger than those of the first to third inner peripheral lips 53, 54 and 55.

The body 51 constitutes a substantially ¾ area on a rear end side of the seal 50 in the front-rear direction. The body p 51 has an elliptical front shape long in the lateral direction. A first outer peripheral lip 57 (seal functioning portion as claimed) in the form of a projecting rib extending in the circumferential direction and continuous over the entire circumference is formed at a front position on the outer periphery of the body 51. A second outer peripheral lip 58 (seal functioning portion as claimed) in the form of a projecting rib extending in the circumferential direction and continuous over the entire circumference is formed substantially in a central part in the front-rear direction on the outer periphery of the body 51.

An outer peripheral auxiliary lip 59 in the form of a projecting rib extending in the circumferential direction and continuous over the entire circumference is formed at a position of a rear end part on the outer periphery of the body 51. Three lips 57, 58 and 59 are formed side by side in the front-rear direction on the outer periphery of the body 51. Projecting dimensions of the first outer peripheral lip 57, the second outer peripheral lip 58 and the outer peripheral auxiliary lip 59 from the outer peripheral surface of the body 51 are all equal.

The body 51 constitutes rear end side areas 52R (substantially ¾ areas on rear end sides) of the seal holes 52. The second inner peripheral lip 54, the third inner peripheral lip 55 and the guiding surface 56 are formed in the rear area 52R of the seal hole 52. The first inner peripheral lip 53 is arranged in front of the body 51. The first outer peripheral lip 57 and the second inner peripheral lip 54 are arranged substantially at the same position in the front-rear direction. Further, the second outer peripheral lip 58 and the third inner peripheral lip 55 are arranged substantially at the same position in the front-rear direction. Specifically, a front end side part of the second outer peripheral lip 58 and a rear end side part of the third inner peripheral lip 55 are arranged in the same area in the front-rear direction. Further, the outer peripheral auxiliary lip 59 and the guiding surface 56 are arranged substantially at the same position in the front-rear direction.

The body 51 is a solid resilient portion 59 in the entirety thereof. Thus, there are no hollow parts such as grooves and recesses between the inner peripheral surfaces of the rear end side areas 52R of the seal holes 52 and the inner peripheral surface of the body 51. Further, there are no hollow parts such as grooves and recesses between the inner peripheral surfaces of the rear end side areas 52R of the vertically adjacent seal holes 52. Similarly, there are no hollow parts such as grooves and recesses also between the inner peripheral surfaces of the rear end side areas 52R of the laterally adjacent seal holes 52.

The following portions 61 are arranged separately in upper and lower stages to individually correspond to the plurality of terminal accommodating chambers 21. Each following portion 61 projects forward (toward the terminal fitting 24) from the front surface of the body 51. The front end (projecting end) of the following portion 61 is located in front of the front end of the first outer peripheral lip 57. One following portion 61 constitutes a front area 52F of one seal hole 52 (area of the seal hole 52 in front of the body 51 and substantially ¼ area on a front end). The first inner peripheral lip portion 53 is formed in the area 52F of the seal hole 52. That is, the body 51 is formed with two lips (second inner peripheral lip 54 and third inner peripheral lip 55), whereas the following portion 61 is formed with only one lip (first inner peripheral lip 53).

Each following portion 61 is individually and resiliently relatively displaceable with respect to the body 51. A relative displacement of the following portion 61 is such resilient deformation to be inclined in directions (vertical direction and lateral direction) intersecting with axial directions (front-rear direction) of the seal hole 52 and the wire 26 in the seal hole 52. The following portions 61 adjacent to each other in the vertical or lateral direction are spaced apart so as not to contact (interfere with) each other when being resiliently deformed. When the following portion 61 is resiliently deformed, the first inner peripheral lip 53 is displaced integrally with the following portion 61.

The seal 50 configured as described above is mounted into the housing 20 with the front end surface of the body 51 held in contact with the rear surface of the housing 20. In a mounted state, all the following portions 61 are accommodated in an accommodation recess 23 of the housing 20. The following portions 61 and the inner peripheral surface of the accommodation recess 23 are spaced apart so that the following portions 61 do not contact (do not interfere with) the inner peripheral surface of the accommodation recess 23 when being resiliently deformed in the vertical direction or lateral direction.

The wire 26 extending rearward from the crimping portion 25 of the terminal fitting 24 is drawn out rearwardly to the outside of the rear holder 45 through the seal 50 and the rear holder 45. For example, if a drawn-out part of the wire 26 is pulled up as shown in FIG. 7, the wire 26 in an area passed through the seal 50 is inclined forward. At this time, the position of the crimping portion 25 is slightly lowered.

Then, the following portion 61 follows the posture inclination of the wire 26 and is obliquely resiliently deformed such that a front end faces down. At this time, since the first inner peripheral lip 53 formed on the inner periphery of the following portion 61 becomes oblique integrally with the following portion 61, the first inner peripheral lip 53 is held in close contact with the outer periphery of the wire 26 over the entire circumference with a constant pressing force. In this way, the inner periphery of the seal hole 52 and the outer periphery of the wire 26 are reliably held in a liquid-tight state.

Further, the first and second outer peripheral lips 57, 58 of the body 51 are held in close contact with a sealing surface of a frame, and the second and third inner peripheral lips 54, 55 of the body 51 are resiliently held in close contact with the outer peripheries of the wires 26. A solid resilient portion 60 is present between the first outer peripheral lip 57 and the second inner peripheral lip 54 in a radial direction of the wire 26, and also between the second outer peripheral lip 58 and the third inner peripheral lip 55 in the radial direction of the wire 26. Thus, even if the following portion 61 is resiliently deformed, the resilient portion 60 (body 51) itself is not deformed significantly. In this way, the first and second outer peripheral lips 57 and 58 and the sealing surface are held reliably in a liquid-tight state and the second and third inner peripheral lips 54 and 55 and the wire 26 held reliably held in a liquid-tight state.

The invention is not limited to the above described embodiments. For example, the following embodiments also are included in the scope of the invention.

Although the following portion constitutes only one seal hole and the plurality of following portions individually project from the body in the first and second embodiments, one following portion may constitute the plurality of seal holes. In this case, only one following portion may project from the body and constitute all the seal holes or one following portion may constitute a plurality of seal holes when a plurality of following portions project from the body.

Although the entire area of the body from the front end to the rear end serves as the solid resilient portion in the first and second embodiments, an area of the body in front of or behind the seal functioning portion (outer peripheral lip) may not be solid by including hollow parts such as grooves.

Although only one seal functioning portion is provided in the first embodiment, a plurality of seal functioning portions spaced apart in the front-rear direction may be provided.

Although two seal functioning portions are provided in the second embodiment, one, three or more seal functioning portions may be provided.

Although the body is formed with one inner peripheral lip in the first embodiment, the body portion may be formed with a plurality of inner peripheral lip portions.

Although the body is formed with two inner peripheral lip portions in the second embodiment, the body may be formed with one, three or more inner peripheral lips.

Although the body is formed with as many inner peripheral lips as the seal functioning portions in the first and second embodiments, the number of the inner peripheral lips formed on the body may be different from that of the seal functioning portions.

Although the following portion is formed with two inner peripheral lip portions in the first embodiment, the following portion may be formed with one, three or more inner peripheral lips.

Although the following portion is formed with one inner peripheral lip in the second embodiment, the following portion may be formed with a plurality of inner peripheral lips.

Although the number of the inner peripheral lips formed on the following portion is larger than that of the inner peripheral lips of the body in the above first embodiment, the number of the inner peripheral lips formed on the following portion may be equal to or smaller than that of the inner peripheral lips of the body.

Although the number of the inner peripheral lips formed on the following portion is smaller than that of the inner peripheral lips of the body in the above second embodiment, the number of the inner peripheral lips formed on the following portion may be equal to or larger than that of the inner peripheral lips of the body.

Although the inner periphery of the peripheral wall and the outer peripheries of the following portions are linked by the linking portions in the first embodiment, the seal may include no linking portions configured to link the inner periphery of the peripheral wall and the outer peripheries of the following portions.

Although the following portions project farther forward than the front end of the peripheral wall in the first embodiment, the front ends of the following portions may be at the same position as or behind the front end of the peripheral wall in the front-rear direction.

Although the outer periphery of the seal is held in close contact with the inner periphery of the frame for accommodating the housing in the first and second embodiments, the invention can be applied also when the outer periphery of the seal is held in close contact with a peripheral wall integrally formed to the housing.

LIST OF REFERENCE SIGNS

A, B . . . waterproof connector

20 . . . housing

24 . . . terminal fitting
26 . . . wire
30, 50 . . . seal
31, 51 . . . body
32, 52 . . . seal hole
32F, 52F . . . front area of seal hole
32R, 52R . . . rear area of seal hole
37 . . . outer peripheral lip (seal functioning portion)
38F . . . front outer peripheral auxiliary lip (auxiliary seal portion)
39, 60 . . . resilient portion
40, 61 . . . following portion
41 . . . peripheral wall
44 . . . linking portion
47 . . . groove
57 . . . first outer peripheral lip (seal functioning portion)
58 . . . second outer peripheral lip (seal functioning portion)

What is claimed is:

1. A seal to be mounted into a rear end part of a housing into which terminal fittings are to be inserted from behind, the seal being formed from a resilient material as a single component and having seal holes configured to allow wires connected to rear end parts of the terminal fittings to pass therethrough in a liquid-tight manner, comprising:

a body constituting rear areas of the seal holes and having a seal functioning portion formed on an outer periphery, an area between inner peripheries of the seal holes and the seal functioning portion defining a solid resilient portion;

a peripheral wall projecting forward from an outer periphery of a front surface of the body and having an auxiliary seal portion formed on an outer periphery following portions projecting forward of the seal functioning portion from the front surface of the body and projecting farther forward than the peripheral wall, the following portions constituting front areas of the seal holes and being resiliently deformable in a direction intersecting with a penetrating direction of the seal holes; and a groove formed between the following portion and the peripheral wall, the groove being configured to avoid interference with the peripheral wall when the following portion is deformed resiliently.

2. The seal of claim 1, wherein each of the following portions has only one seal hole and the following portions individually project from the body.

3. A waterproof connector, comprising:

a housing with opposite front and rear ends, an accommodation recess extending into the rear end of the housing, terminal accommodating chambers extending through the housing a seal mounted at the rear end of the housing; and seal holes formed in the seal at positions aligned respectively with the terminal accommodating chambers and configured to allow wires connected to rear end parts of a terminal fittings to pass therethrough in a liquid-tight manner, wherein the seal includes:

a body constituting rear areas of the seal holes and having a seal functioning portion formed on an outer periphery, an area between inner peripheries of the seal holes and the seal functioning portion defining a solid resilient portion; and following portions projecting forward of the seal functioning portion from a front surface of the body and constituting front areas of the seal holes, the following portions protecting into the accommodation recess and being spaced inward from a peripheral surface of the accommodation recess so that the following portions are resiliently deformable in directions intersecting a penetrating direction of the seal holes in a state mounted in the housing.

4. The waterproof connector of claim 3, wherein the seal further comprises a peripheral wall projecting forward from an outer periphery of a front surface of the body and having an auxiliary seal portion formed on an outer periphery.

5. The waterproof connector of claim 4, wherein a groove is formed between the following portion and the peripheral wall, the groove being configured to avoid interference with the peripheral wall when the following portion is deformed resiliently.

6. The seal of claim 5, further comprising a linking portion configured to link an inner periphery of the peripheral wall and the outer periphery of the following portion.

7. The waterproof connector of claim 5, wherein a projecting distance of the following portions from the front surface of the body exceeds a projecting distance of the peripheral wall from the front surface of the body.

8. The waterproof connector of claim 7 wherein the peripheral wall has a front surface engaged against the rear end of the housing at a position outward of the accommodation recess.

9. The waterproof connector of claim 3, wherein the seal is formed from a resilient material as a single component.

10. The waterproof connector of claim 3, wherein the seal holes are flared outward to wider cross-sectional dimensions at positions adjacent a rear end of the seal.

11. The seal of claim 3, wherein the seal holes are flared outward to wider cross-sectional dimensions at positions adjacent a rear end of the seal.

* * * * *